US005081847A

United States Patent [19]

Anderson, Jr.

[11] Patent Number: 5,081,847

[45] Date of Patent: Jan. 21, 1992

[54] VARIABLE FLOW ORIFICE TUBE

[75] Inventor: Russell C. Anderson, Jr., N. Tonawanda, N.Y.

[73] Assignee: General Motors Corporation, Detroit, Mich.

[21] Appl. No.: 588,622

[22] Filed: Sep. 24, 1990

[51] Int. Cl.[5] ..... F25B 41/04

[52] U.S. Cl. ..... 62/222; 62/528; 137/504; 138/26; 138/42; 138/43; 138/44; 138/45; 138/46

[58] Field of Search ..... 62/222, 528; 137/497, 137/504; 138/26, 31, 42–46

[56] References Cited

U.S. PATENT DOCUMENTS

| | | | |
|---|---|---|---|
| 920,716 | 5/1909 | Beckman | 137/517 |
| 2,816,572 | 12/1957 | Pratt | 137/517 |
| 3,023,591 | 3/1962 | Tilney | 62/222 X |
| 3,296,816 | 1/1967 | Weibel, Jr. et al. | 62/210 |
| 3,409,050 | 11/1968 | Weese | 138/45 |
| 3,431,944 | 3/1969 | Sakuma | 138/43 X |
| 3,482,415 | 12/1969 | Trask | 137/538 |
| 3,805,824 | 4/1974 | Robbins, Jr. | 137/504 |
| 3,872,884 | 3/1975 | Busdiecker et al. | 137/504 X |
| 3,893,486 | 7/1975 | Meyers | 138/31 |
| 3,973,410 | 8/1976 | Putman | 62/527 |
| 4,009,592 | 3/1977 | Boerger | 62/222 |
| 4,066,096 | 1/1978 | Lind, Jr. | 137/504 |
| 4,375,228 | 3/1983 | Widdowson | 138/46 |
| 4,951,478 | 8/1990 | McDonald | 62/222 |

*Primary Examiner*—William E. Tapolcai
*Attorney, Agent, or Firm*—Ronald L. Phillips

[57] ABSTRACT

A variable flow restrictor valve is disclosed that is adapted to be inserted in a fluid line to provide first and second alternative flow paths therethrough in accordance with the pressure differential between inlet and outlet ends of the valve. The assembly is characterized by use of a moveable orifice tube which defines one of the alternative paths and an intermediate part of a valve housing defines a flow path which forms another alternative flow path having flow therethrough regulated by a stop disk and a valve disk both of which are fixed to the orifice tube on either side of the intermediate part to position the valve disk to either close or open the another alternative flow path in accordance with the aforesaid pressure differential.

10 Claims, 2 Drawing Sheets

VARIABLE FLOW ORIFICE TUBE

FIELD OF THE INVENTION

This invention relates to variable flow orifice tubes and more particularly to variable flow orifice tubes having parallel flow paths selectively opened and closed to produce first and second fluid flow levels in accordance with differential line pressure.

BACKGROUND OF THE INVENTION

In fluid flow systems it is desirable to provide a fixed orifice tube of precise form to provide a low cost device for the control of fluid flow. While such devices are suitable for their intended purpose in some cases more than one level of flow is desired which desirably should be regulated by like low cost but precise fixed restriction control.

An example of a system requiring such variable flow restriction is in the field of automotive air conditioning. Such systems include an engine driven compressor which draws refrigerant vapor from an evaporator unit over which ambient air is directed into the passenger compartment by a fan unit. The evaporator extracts heat from the ambient air by evaporating liquid refrigerant to form refrigerant vapor which is returned to the compressor. The compressor compresses the refrigerant vapor and directs it into a condenser unit where high pressure refrigerant vapor is cooled and collected as high pressure refrigerant liquid. It is common practice in such system to provide a fixed restriction such as a fixed orifice tube or capillary tube defining a high pressure liquid refrigerant line between the outlet of the condenser and the inlet of the evaporator. The conventional orifice tube in air conditioning system can work in conjunction with an accumulator/dehydrator unit to regulate refrigerant flow in the system based upon cooling demand.

In such refrigerant systems, a cycling clutch control senses the operating condition of the system at the orifice tube to turn a magnetically operated clutch on and off so as to cycle the operation of the compressor in accordance with the heat load on the refrigerant system. One disadvantage of the fixed orifice tube type systems is that compressor capacity under idle speed conditions (even when controlled to be on all the time) may be so limited because of compressor size as to be unable to provide enough flow of high pressure refrigerant liquid (or to maintain sufficient pressure differential for proper expansion) across the fixed restriction defined by the single orifice tube. Such limited capacity can cause the evaporator to run in a less efficient non-flooded condition at engine idle or when the car speed is decreased as in the case of heavy, slow moving traffic. This condition, coupled with the associated decreased condensing ability due to reduced airflow through the condenser at idle speeds, can result in a higher temperature and pressure in the liquid refrigerant. On the other hand. in some cases where there is more than enough compressor capacity, such idle operation can even further increase the heat load on the condenser which in turn can result in even higher temperatures and pressures in the liquid refrigerant. Thus, with either limited or unlimited compressor capacity at idle, such increases in pressure will tend to force more liquid refrigerant across the fixed orifice tube from the high pressure side thereof to the low pressure side of the system. With limited compressor capacity systems, such increased refrigerant flow can cause an excessive flow of refrigerant which is greater than can be pumped by the compressor. With unlimited compressor capacity systems, such increased refrigerant flow is insufficient to moderate the otherwise excessively high condenser outlet pressures.

It has therefore been suggested that multiple stage or variable flow restrictors be operated by differential pressure across the liquid refrigerant line to control the refrigerant flow in automotive air conditioning systems. Examples of such variable flow devices are set-forth in U.S. Pat. Nos. 3,296,816 and 4,375,228 assigned to the assignee of this invention. Other variable flow devices are disclosed in U.S. Pat. Nos. 920,716; 2,816,572; 3,482,415; 3,973,410; and 4,009,592.

None of the known variable orifice systems is readily adaptable to use simple mechanical valving components to produce either a decrease in high pressure liquid refrigerant flow or an increase in high pressure liquid refrigerant flow depending upon whether an associated system either has limited compressor capacity or an unlimited compressor capacity under engine idle conditions.

SUMMARY OF THE INVENTION

A feature of the present invention is to provide a simplified variable orifice device which uses a standard orifice tube that moves with respect to a fixed valve body and which carries a single valve disk and a single stop disk for movement with respect to an intermediate part of the fixed valve body to control an alternative flow path through the intermediate part to provide more high pressure liquid refrigerant flow to an evaporator when a system has unlimited compressor capacity by opening the alternative flow path when the pressure differential in the liquid line across the orifice tube is high or to provide less high pressure liquid refrigerant flow to an evaporator when a system has limited compressor capacity and to provide for such converse control merely by reversing the position of the valve disk and stop disk on the moveable orifice tube.

Another object of the invention is to simplify the assembly and operation of variable restriction flow devices by providing a continuously open standard orifice tube connected to valve components that control an alternative flow path through a fixed valve body to provide either increased or decreased refrigerant flow without inserting other components through the standard orifice flow tube or without providing secondary orifice holes therein.

Another object of the present invention is to provide a simplified variable orifice restrictor valve including a standard orifice tube which is associated with low cost, easily assembled valve disk and stop disk components that are exposed to the pressure differential across a liquid refrigerant line in an automotive air conditioning system to produce a force on the orifice tube that moves it with respect to a fixed valve body to control refrigerant flow through an alternative flow path in the valve housing.

Another object of the invention is to provide such a variable orifice restrictor valve wherein the position of the valve disk and stop disk are respectively positioned on the downstream end and upstream ends of the orifice tube and operatively arranged with respect to a valve seat at a flow path in the control valve body so as to cause refrigerant to simultaneously flow through the alternative flow path and the orifice tube to flood the evaporator with liquid refrigerant when an associated compressor has unlimited capacity and when the pressure differential across the orifice tube is raised under engine idle conditions. Alternatively the simplified control valve of this object is operative under lower differential pressures across the orifice tube to limit refrigerant flow through only the orifice tube in a manner similar to the operation of a fixed single orifice tube design during low load, high speed vehicle operation.

Another object of the invention is to provide such a simplified variable orifice restrictor valve having the valve disk and stop disk arranged on the upstream and downstream ends of the orifice tube respectively and operatively arranged with respect to a valve seat and a flow path in the control valve body so as to prevent flow through the alternative flow path when the control valve is used in association with a refrigerant system that includes a compressor with a limited capacity; and wherein the orifice tube is sized for supplying less liquid refrigerant to the evaporator so as to cause it to run at a lower suction pressure and a corresponding lower core temperature for improving evaporator performance under engine idle conditions. Alternatively the simplified control valve of this object is operative under lower differential pressures across the orifice tube to open the alternative flow path whose flow area combined with that of the restricted area orifice tube is equal or is substantially equal to the flow area of a standard fixed orifice tube design to provide similar performance under low-load, high-speed, vehicle operation.

A feature of the present invention is that a standard orifice tube is mounted in a fixed valve body for movement relative thereto; a valve disk and a stop disk are fixed to the orifice tube on either side of an intermediate part of the valve body with a flow path therein which will be opened or closed to provide an alternative flow path to that of the orifice tube to either provide more refrigerant flow under idle conditions when a compressor has unlimited capacity or to provide less refrigerant flow when an associated compressor has limited capacity for supplying the refrigerant flow requirements of the refrigerant system.

Another feature of the present invention is to provide a variable orifice restrictor valve for controlling refrigerant flow in an automobile air conditioning system wherein the valve has an outer housing with an inlet end adapted to be connected to the outlet of a refrigerant compressor having refrigerant supplied thereto by a compressor driven by the automobile engine and the outer housing further includes an outlet end adapted to be connected to the inlet of a refrigerant evaporator having an outlet connected to the compressor and wherein a valve body is fixedly connected in the housing having an upstream part always in communication with the inlet end, a downstream part always in communication with the outlet end and an intermediate part having a first flow path for producing a controlled restriction of flow between the inlet end and the outlet ends; a second flow path for producing a controlled restriction of flow between the inlet and outlet ends of the outer housing is defined by an orifice tube slideably fit within said intermediate part for axial movement relative thereto and having opposite open ends one of which is located within the upstream part of the valve body and the other of which is located within the downstream part of the valve body and the orifice tube is continuously open for flow of refrigerant between the inlet end and the outlet end of the housing; valve means are fixedly secured to the orifice tube for movement therewith and pressure differential between the inlet and outlet ends of the housing exerts a pressure on the valve means to produce a resultant force that causes movement of the orifice tube in response to differential pressure conditions between the inlet and outlet end of the housing in a direction axially of the intermediate part to either increase refrigerant flow into an evaporator or to decrease refrigerant flow into an evaporator under idle speed conditions of operation depending upon whether the compressor in the system has an unlimited capacity or a limited capacity, respectively.

Among the important structural features of the present invention is the provision of a standard orifice tube that carries a valve disk and a stop disk arranged either on the upstream and downstream end of the tube or in a converse location depending upon whether the tube is moved to control flow in a refrigerant system for an automotive air conditioning system having a compressor which has either a limited capacity or an unlimited capacity for supplying high pressure liquid refrigerant to the evaporator of the air conditioning system. Moreover, this structural feature is adapted for inclusion in compactly arranged valve assemblies which are easily mass produced.

These and other objects, advantages and features of the present invention will become more apparent from the following description and drawings in which:

DETAILED DESCRIPTION OF PREFERRED EMBODIMENTS OF THE INVENTION

Figure 1:
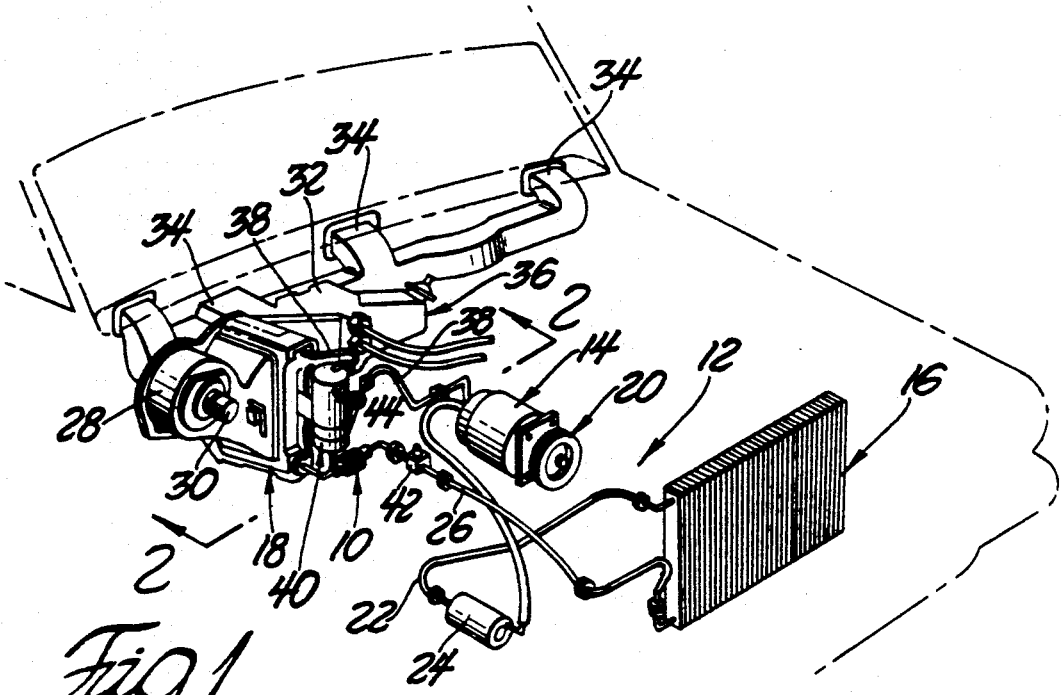
FIG. 1 is a perspective view of an automotive air conditioning system employing the preferred embodiment of the variable flow restrictor valve of the present invention.
Figure 2:
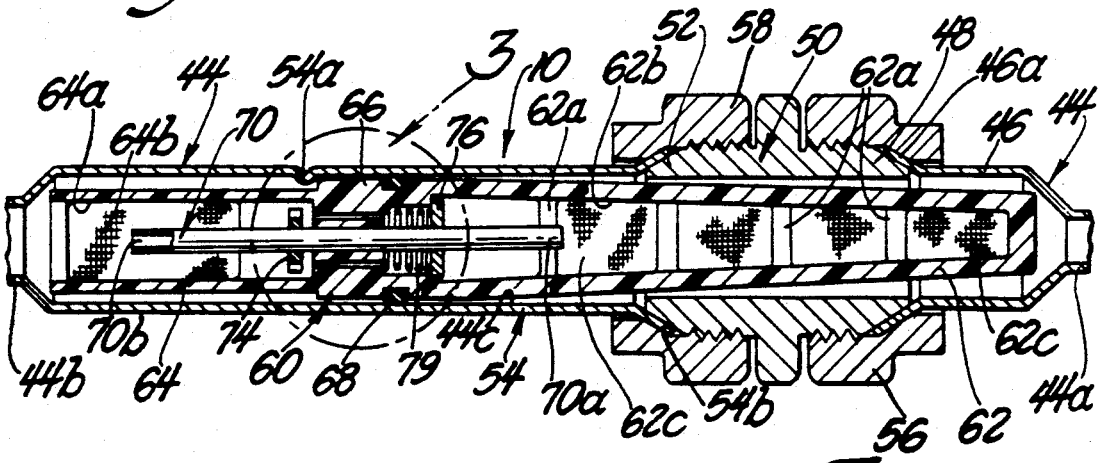
FIG. 2 is an enlarged, longitudinal sectional view of the restrictor valve of FIG. 1 taken along the line 2—2 of FIG. 1.

Referring to FIG. 1, a variable flow restrictor valve 10 of the present invention is shown installed in an automotive air conditioning system 12. The automotive air conditioning system 12 includes a compressor 14, a condenser 16 and an evaporator 18. The compressor 14 is driven through an electromagnetic clutch 20 by the vehicle engine (not shown) so as to deliver refrigerant as high pressure vapor to the inlet of the condenser 16 via a discharge line 22 and a muffler 24. The refrigerant is cooled by ram air flow and by engine fan air flow across tube and fin components of the condenser 16 in a known manner and is thence discharged as high pressure refrigerant liquid to a high-pressure liquid line 26 in which the valve 10 of the present invention is located. The valve 10 has its outlet connected to the inlet of the evaporator 18. Ambient air is directed across the tubes and fins of the evaporator 18 by a blower fan 28 driven by an electric motor 30. Air cooled by the evaporator is directed from the discharge of the blower fan 28 and is directed into a vehicle passenger compartment through a duct 32 thence through an air distribution ports 34 under the control of a mode control system 36.

Low pressure refrigerant vapor exits the evaporator 18 through a suction line 38 containing an accumulator dehydrator unit 40 and is returned by this line to the suction side of the compressor 14. The air conditioning system further includes a safety pressure switch 42 for controlling the clutch 16 and a high-pressure gauge connection 44 both of which are connected in the high-pressure liquid line 26 between the condenser 16 and the evaporator 18. The aforesaid system is representative of a cycling clutch orifice tube system of a conventional type except that the valve 10 of the present invention replaces a fixed orifice expansion device for reasons to be discussed. In such conventional systems heretofore, a fixed orifice expansion device has been provided consisting of an inlet screen, a brass tube of a precise inside diameter and precise length and a diffuser screen on the outlet end of the fixed orifice expansion is provided to reduce noise. In such systems the precise size of the orifice is selected to provide satisfactory performance under most conditions of engine speeds and cooling load on the evaporator. Such fixed restriction orifice systems usually operate the evaporator under slightly flooded conditions during low load, high speed vehicle operation which results in a decided improvement in performance as compared to systems which regulate refrigerant flow to the evaporator strictly in accordance with the temperature of the evaporator. If the compressor 14 has a limited capacity which is usually the case, it may not be able to provide enough high pressure refrigerant liquid to the evaporator 18 when the engine is idling. Under such conditions there is little ram air flow across the condenser 16 and the quantity of refrigerant is less since the engine driven compressor 14 is driven at a lower speed. Consequently, the evaporator 18 may run in a less efficient non-flooded condition if a single fixed restriction orifice is used in the system.

In accordance with one aspect of the present invention the variable flow restrictor valve 10 responds to changes in the differential pressure across the high pressure liquid line 26 to produce a first and second refrigerant flows to meet refrigerant flow requirements under both high speed and idle speed operation of the vehicle.

In the embodiment of FIGS. 2–6 a control valve 10 is shown which will provide for such dual refrigerant flow requirements in systems having a compressor 14 with a limited capacity which is the usual case since automotive compressors are limited in size and weight to control costs, overall vehicle weight and the load on the engine.

More specifically, the variable flow restrictor valve 10 has an outer sheet metal housing 44 formed in part by a tube 46 with a flared end **46*a* that is seated on a conical end 48 of a pipe coupling member 50. The pipe coupling member 50 has an opposite conical end surface 52 which receives a flared end 54*b* on a tube 54 adapted to be connected to the inlet of the evaporator 18. Suitable coupling nuts 56, 58 are threaded on opposite threaded ends of the pipe coupling member 50 for securing the tube 46 and the tube 54 in the high pressure refrigerant line 26. The tube 54 has a inwardly upset segment 54*a***.

A valve body 60 is inserted in the tube section 54 to be axially engaged by the segment **54*a* for locating the valve body 60 within the high pressure liquid refrigerant line 26. The valve body 60 has an upstream part 62, a downstream part 64 and an intermediate part 66. The upstream part 62 is directly communicated with the inlet end 44*a* of the housing 44 and the downstream part 64 is directly communicated with the outlet end 44*b* of the housing 44. The upstream part 62 has a plurality of ribs 62*a* which form openings 62*b* for flow of refrigerant from the outlet of the condenser 16. The openings 62*b* are covered by screens 62*c*** for reducing noise and for filtering particles from the refrigerant flow.

A single O-ring seal 68 is carried in a groove on the outer surface of the intermediate part 66 to engage the inner surface **44*c* of the housing 44 to prevent bypass of the refrigerant flow around alternative flow paths formed through the intermediate part 66**.

The downstream part 64 of the valve body 60 has an opening **64*a* therein covered by a screen 64*b* to attenuate noise on the downstream end of the valve body 60**.

An orifice tube 70 is slideably supported in a bore 72 through the intermediate part 66. The orifice tube 70 has opposite open ends **70*a*, 70*b* in fluid communication respectively with the inlet end 44*a* and outlet end 44*b* of the valve housing 44 so as to define a continuously open flow path for refrigerant flow from the condenser 16 to the evaporator 18. A stop disk 74 is connected to the outer surface of the tube 70 at the downstream end thereof. A valve disk 76 is connected to the outer surface of the tube 70** at the upstream end thereof.

The intermediate part 66 has a plurality of circumferentially located, equidistantly spaced secondary flow channels 78 forming alternative flow paths to the flow path through the open center **70*c* of the orifice tube 70**.

A flat surface **66*a* is formed on the downstream end of the intermediate part 66 and the upstream end of the intermediate part has a bore 66*b* therein surrounded by an annular surface 66*c* defining a valve seat for the valve disk 76. A compression spring 79 is supported within the bore 66*b* to have one end in engagement with the intermediate part 66 and the opposite end in engagement with the downstream face 76*a* of the valve disk 76. The compression spring 79 biases the valve disk 76 into a normally open position in which the orifice tube 70 is shifted to the right as viewed in FIG. 4 and in which the stop disk 74 is in engagement with the flat surface 66*a*** to limit the extent of the opening movement.

Figure 5:
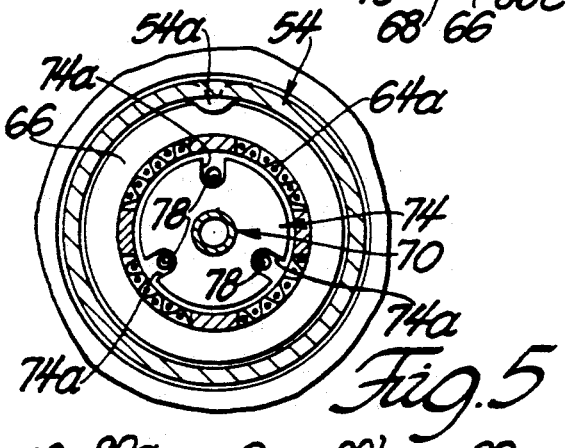
FIG. 5 is a sectional view taken along line 5—5 of FIG. 3 looking in the direction of the arrows.
Figure 6:
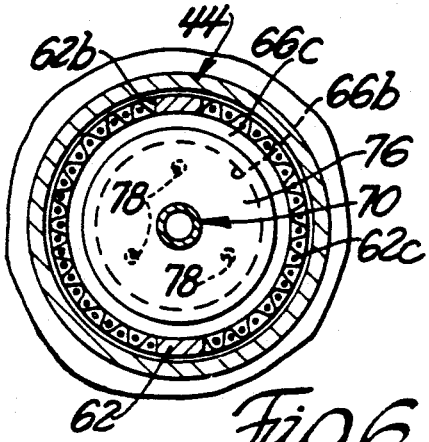
FIG. 6 is a sectional view taken along line 6—6 of FIG. 3 looking in the direction of the arrows.

The stop disk 74 has a plurality of equidistantly spaced slots **74*a* in the outer periphery thereof which overlie the outlet of each of the secondary flow channels 78 as best shown in FIG. 5**.

Figure 3:
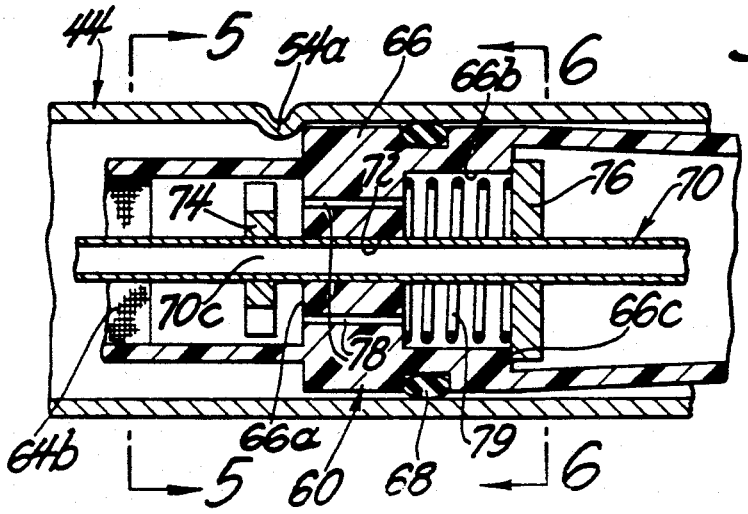
FIG. 3 is an enlarged sectional view of region 3 in FIG. 2 showing a first control position of the restrictor valve.
Figure 4:
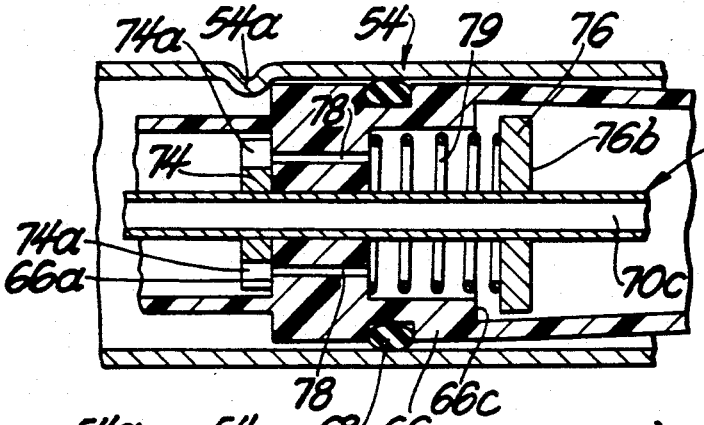
FIG. 4 is a view like FIG. 3 showing a second control position of the restrictor valve.

Operation of the embodiment of FIGS. 2–6 is as follows: The compressor 14, in this embodiment has a limited capacity to supply the requirements of refrigerant flow in the system 12. When the system 12 is operated under engine idle, low vehicle speed conditions, the pressure of the condenser 16 rises to increase the pressure differential in the liquid line 26 across the orifice tube 70. The higher differential pressure across the orifice tube 70 in the liquid line 26 causes a pressure to be exerted on the front surface **76*b* of the valve disk 76 equal to the pressure differential multiplied by the frontal area of the valve disk 76. At a given set-point, the pressure differential becomes great enough to counteract the opening force of the compression spring 79. The valve disk 76 is then closed by seating against the annular surface 66***c* on the intermediate part 66 of the valve body 60 as shown in FIG. 3.

Refrigerant flow from the condenser 16 to the evaporator 18 is thus limited to flow through the continuously open orifice tube 70. In this embodiment the orifice tube 70 is sized smaller than a standard fixed orifice tube system which would normally operate to cause the evaporator to operate in a non-flooded condition; to compensate for this condition, the reduced flow area through the smaller sized orifice tube 70 decreases the refrigerant flow at engine idle operation to cause the evaporator 18 to run at a lower suction pressure and a corresponding lower core temperature to improve performance over standard fixed orifice systems.

Conversely, under high-speed, low-load operating conditions, the capacity of the compressor 14 is no longer limited since higher pulley speeds are achieved at higher engine speeds with a resulting increase in the refrigerant volume pumped per unit of time. Increased condensing capacity is achieved at the higher speed operation as well since ram air flow through the condenser 16 is increased, causing a resulting decrease in the pressure in the condenser. This decreased condenser pressure acts so as to lower the pressure differential across the orifice tube 70. The compression spring 79 exerts an axial force on the valve disk 76 which is not balanced by the resultant pressure forces on the valve disk 76. Consequently, the valve disk 76 and the orifice tube 70 connected thereto move into the open position in FIG. 4.

High pressure liquid refrigerant then flows through the flow path defined by the open center 70*c* of the smaller sized orifice tube 70 and through a second flow path around the perimeter of the valve disk 76, thence through the channels 78 and thence through the slots 74*a* for discharge in parallel with the flow through the orifice tube 70. The alternative flow path through the channels 78 increase refrigerant flow quantities under high-speed, low-load conditions to flood the evaporator thereby producing greater efficiency. The alternative flow path volume in conjunction with the flow through the orifice tube 70 can be selected to be comparable to the flow area in a standard fixed orifice system to provide similar performance under high-speed, low-load vehicle operation.

Figure 7:
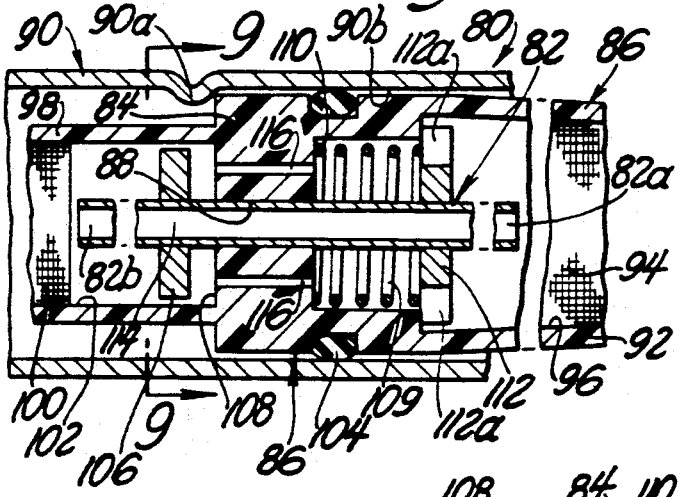
FIG. 7 is a view like FIG. 3 showing another embodiment of the invention having a valve component therein in a first control position.
Figure 9:
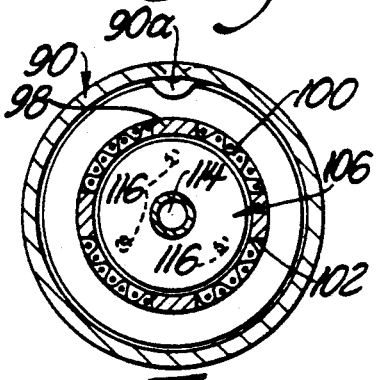
FIG. 9 is a sectional view taken along the line 9—9 of FIG. 7 looking in the direction of the arrows.
Figure 8:
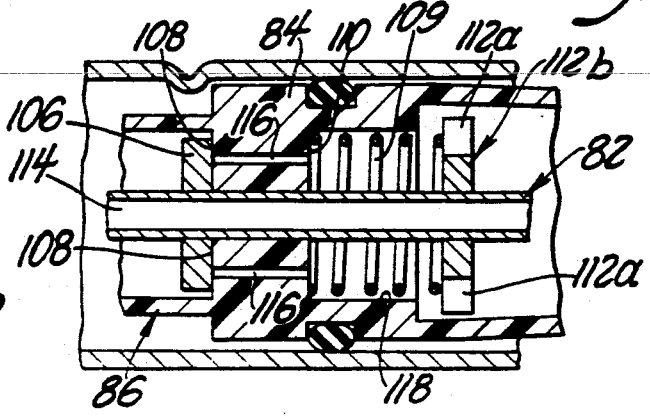
FIG. 8 is a view like FIG. 7 showing a second control position of the valve component therein.

Referring now to the embodiment of FIGS. 7–9, a variable orifice restrictor valve 80 is illustrated in which a standard orifice tube 82 is supported in an intermediate part 84 of a valve body 86 corresponding to the valve body 60 in the embodiment of FIGS. 2–6. In this embodiment the intermediate part 84 has a central bore 88 through which the orifice tube 82 is directed and in which the standard orifice tube 82 is slideably supported. The standard orifice tube 82 has opposite open ends 82*a*, 82*b* which are respectively directly in communication with the inlet end and the outlet end of an outer housing 90 corresponding to housing 44 in the first embodiment.

The valve body 86 also has an upstream part 92 a portion of which is shown in FIG. 7 with an inlet screen 94 covering inlet openings 96 in direct communication with the inlet end of the outer housing 90. The valve body 86 further includes a downstream part 98 with an outlet screen 100 covering an outlet opening 102 therein. The outlet opening 102 directly communicates with the outlet end of the outer housing 90. As in the first embodiment the valve body 86 is axially positioned within the outer housing 90 by an inwardly bent portion 90*a* thereon and the valve body 86 is sealed between the upstream and downstream parts 92, 98 by an O-ring seal 104 carried in a groove in the intermediate part 84 that seals against the inner surface 90*b* of the outer housing 90.

In this embodiment a valve disk 106 is fixedly secured to the downstream end of the orifice tube 82. It is positioned closed against a downstream valve seat 108 on the intermediate part 84 (FIG. 8) by a compression spring 109 located between the upstream end 110 of the intermediate part 84 and a stop disk 112 fixedly secured to the upstream end of the orifice tube 82.

A central opening 114 in the standard orifice tube 82 is continuously fluidly communicated with the liquid line 26 at the inlet and outlet ends of the outer housing 90. An alternative flow path is defined by a plurality of circumferentially located, equidistantly spaced channels 116 through the intermediate part 84. The stop disk 112 has a plurality of peripheral slots 112*a* which provide communication with a bore 118 in the intermediate part 84 and thence to the channels 116 when the valve disk 106 is opened as shown in FIG. 7.

As noted above in this embodiment the position of the valve disk and stop disk are reversed from the embodiment of FIGS. 2–6. The remainder of the valve assembly is configured as in the first embodiment and by virtue of the change the operating mode of the device is configured to provide dual flow restriction through parallel passes so as to improve the efficiency of a automotive air conditioning system having a compressor whose capacity is unlimited and hence able to provide sufficient quantities of refrigerant to the condenser under engine idle conditions.

In operation, the valve 80 will respond to engine idle operation and a resultant elevation in the pressure differential across the upstream and downstream parts 92, 98 of the valve body 86 as follows:

When the pressure differential in the liquid line 26 across the standard orifice tube 82 is increased at engine idle conditions, a higher pressure differential across the orifice tube 82 will cause a pressure to be exerted on the front surface 112*b* of the stop disk 112 equal to the higher pressure differential multiplied by the frontal area of the stop disk 112. When this pressure reaches a desired set-point, it will counteract the force of the spring 109 to force the valve disk 106 into an open position as shown in FIG. 7. In this operating position, high pressure liquid refrigerant then flows through the slots 112*a* of the stop disk 112, thence through the channels 116, thence around the perimeter of the valve disk 106, in addition to flowing through the parallel flow path defined by the open center 114 of the orifice tube 82. The alternative flow path through channels 116 increase refrigerant flow quantities under low-speed, high-load conditions to flood the evaporator, thereby producing improved performance.

Conversely, for the unlimited compressor capacity case, under high-speed, low-load conditions, the pressure differential in the liquid line 26 across the standard orifice tube 82 is reduced by virtue of the increased condensing capacity due to increased ram air flow over the condenser fins at higher vehicle speeds. Under these condition, the compression spring 109 will exert an axial force on the stop disk 112 which is not balanced by the reduced pressure differential acting on the upstream face 112*b* of the stop disk 112 causing the orifice tube 82 and the valve disk 106 to move to the closed position, as shown in FIG. 8.

In this position, high pressure liquid refrigerant flow is limited to the restricted precision standard orifice flow area of the center 114 of the orifice tube 82. The flow area of the center 114 is like that of a standard fixed orifice tube design found in single fixed orifice designs which are sized to produce a flow of refrigerant into the evaporator 18 under high speed vehicle operation which will produce a desired performance in the system.

The stop disk in either embodiment serves to limit the travel of the moveable orifice tube and valve disk under the bias of the compression spring so as to provide a positive stop against excessive movement. It does so without hindering flow through the respective alternative flow paths of the respective embodiments described herein.

The present invention enables standard cycling clutch orifice tube type control systems for automotive air conditioning systems to be designed which will produce adequate performance at low-speed, high-load conditions as experienced in regions having congested traffic and hot humid climates. The present invention will provide performance without requiring the expense of including a thermal expansion valve and associated components in the refrigerant system. Furthermore, the alternative flow paths also define a flow path which will allow more refrigerant oil to circulate at low-speed conditions thereby to reduce compressor failures due to lack of lubrication especially under conditions in which a low refrigerant charge exists in the refrigerant system.

Having described preferred embodiments of the variable orifice restrictor valve of the present invention and a particularly useful application of each embodiment, it will be understood by those skilled in the art that the desired operation is obtained in a very compact arrangement having few and simple parts that require only slight adjustment to perform control of various systems. In the preferred embodiment there is essentially a moveable orifice tube which carries a stop disk and a valve disk arranged with respect to a single compression spring to regulate parallel flow paths as the differential pressure acts on one or the other of the disks depending upon its location on the upstream end of the moveable orifice tube. But it will also be understood by those skilled in the art that the above-described preferred embodiments are illustrative of the invention which may be modified within the scope of the appended claims.

What is claimed is:

1. A variable orifice restrictor valve for controlling refrigerant flow in an automobile air conditioning system wherein the valve has an outer housing with an inlet end adapted to be connected to the outlet of a refrigerant condenser having refrigerant supplied thereto by a compressor driven by the automobile engine and the outer housing further including an outlet end adapted to be connected to the inlet of a refrigerant evaporator having an outlet connected to the compressor and wherein a valve body is supported in the housing having an upstream part always in communication with the inlet end, a downstream part always in communication with the outlet end and an intermediate part having a first flow path for producing a controlled restriction of flow between the inlet end and the outlet end characterized by:

a first flow opening formed in and directed through said intermediate part for restricting flow through said intermediate part which is in communication with the upstream and downstream parts of said valve body;

a second flow opening formed through said intermediate part including a bore directed through said intermediate part in parallel to said first flow opening, an orifice tube having a center segment slideably fit within said bore for axial movement relative thereto;

said orifice tube having opposite open end segments located exteriorly of said bore on either side of said intermediate part; one of said opposite open segments located within the upstream part of said valve body and the other of said opposite open end segments located within the downstream part of said valve body and said orifice tube being continuously open for continuous flow of refrigerant through said orifice tube between the inlet end and the outlet end of the housing in parallel fluid flow relationship to fluid flow through said first flow opening; and valve means fixedly secured to said orifice tube for movement therewith and responsive to pressure differential between the inlet end and the outlet end of the housing for producing a force on said orifice tube to cause movement of said orifice tube to position said valve means against said intermediate member to open and close said first flow opening by selectively covering and uncovering said first flow opening so as to cause said refrigerant flow to either flow only through both said first flow opening and said orifice tube or through only said orifice tube for varying refrigerant flow between the inlet end and the outlet end of the housing.

2. A variable orifice restrictor valve for controlling refrigerant flow in an automobile air conditioning system wherein the valve has an outer housing with an inlet end adapted to be connected to the outlet of a refrigerant condenser having refrigerant supplied thereto by a compressor driven by the automobile engine and the outer housing further including an outlet end adapted to be connected to the inlet of a refrigerant evaporator having an outlet connected to the compressor and wherein a valve body is supported in the housing having an upstream part always in communication with the inlet end, a downstream part always in communication with the outlet end and an intermediate part having a first flow path for producing a controlled restriction of flow between the inlet end and the outlet end characterized by:

means for forming a first flow path for restricting flow through said intermediated part which is in communication with the upstream and downstream parts of said valve body;

means for forming a second flow path for restricting flow including an orifice tube slideably fit within said intermediate part for axial movement relative thereto;

said orifice tube having opposite open ends one of which is located within the upstream part of said valve body and the other of which is located within the downstream part of said valve body and said orifice tube being continuously open for flow of refrigerant between the inlet end and the outlet end of the housing; and valve means fixedly secured to said orifice tube for movement therewith and responsive to pressure differential between the inlet end and the outlet end of the housing for producing a force on said orifice tube to cause movement of said orifice tube to position said valve means to open and close said first flow path for varying refrigerant flow between the inlet end and the outlet end of the housing;

said valve means including valve disk means selectively engageable with said intermediate part for opening and closing said first flow path for varying refrigerant flow between the inlet end and the outlet end of the housing.

3. The variable flow restrictor valve of claim 2 further characterized by:

said intermediate part including a central hole supporting said orifice tube and further including axially spaced end surfaces one of which defines a valve seat; said means for forming said first flow path in said intermediate part extending between said end surfaces for communication with said upstream and downstream parts of said valve housing;

said valve disk means including a valve disk and a stop disk; said valve disk engageable with said valve seat to close said first flow path at a predetermined differential pressure between the inlet and outlet ends of the housing.

4. The variable flow restrictor valve of claim 2 further characterized by:

said intermediate part including axially spaced end surfaces one of which defines a valve seat;

said valve disk means including a valve disk and spring means operatively associated with said valve disk for biasing said valve disk in an opening direction with respect to said valve seat for opening said flow path through said intermediate part;

a stop disk engageable with said intermediate part to hold said valve disk in an open position with respect to said valve seat;

said valve disk and said stop disk having surface portions exposed to either the pressure at the inlet end of said housing or the pressure at the outlet end of said housing for producing a force on said orifice tube for causing it to shift so as to position said valve disk to either open or close said first flow path in accordance with the pressure differential between the inlet and outlet ends of the housing.

5. The variable flow restrictor valve of claim 2 further characterized by:

said intermediate part having opposite ends one of which defines a valve seat;

said valve disk means including a valve disk and spring means in engagement with said intermediate part and in engagement with said valve disk for biasing said valve disk in an opening direction with respect to said valve seat for opening said first flow path through said intermediate part;

a stop disk engageable with said intermediate part to hold said valve disk in an open position with respect to said valve seat;

said valve disk and said stop disk have planar surface portions thereon exposed to either the pressure at the inlet end of said housing or the pressure at the outlet end of said housing for producing a force on said orifice tube for causing it to shift so as to move said valve disk to open and close the first flow path in accordance with the pressure differential between the inlet and outlet ends of the housing.

6. The variable flow restrictor valve of claim 2 further characterized by:

said intermediate part including a flat end surface on one end thereof and an annular surface offset axially of the opposite end thereof;

said valve disk means including a valve disk and spring means operatively associated with said valve disk for biasing said valve disk in an opening direction with respect to said annular surface for opening said flow path through said intermediate part;

a stop disk engageable with said flat end surface to hold said valve disk in an open position with respect to said valve seat;

said valve disk and said stop disk have planar surface portions exposed to either the pressure at the inlet end of said housing or the pressure at the outlet end of said housing for producing a force on said orifice tube for causing it to shift so as to position said valve disk to either open or close said flow path in accordance with the pressure differential between the inlet and outlet ends of the housing.

7. The variable flow restrictor valve of claim 2 further characterized by:

said intermediate part including a flat end surface on one end thereof and an annular surface offset from the opposite end thereof;

said valve disk means including a valve disk and spring means operatively associated with said valve disk for biasing said valve disk in an opening direction with respect to said flat surface for opening said flow path through said intermediate part;

a stop disk engageable with said annular surface to hold said valve disk in an open position with respect to said valve seat;

said valve disk and said stop disk have planar surface portions thereon exposed to either the pressure at the inlet end of said housing or the pressure at the outlet end of said housing for producing a force on said orifice tube for causing it to shift so as to move said valve disk to open and close in accordance with the pressure differential between the inlet and outlet ends of the housing.

8. A variable orifice restrictor valve for controlling refrigerant flow in an automobile air conditioning system wherein the valve has an outer housing with an inlet end adapted to be connected to the outlet of a refrigerant condenser having refrigerant supplied thereto by a compressor driven by the automobile engine and the outer housing further including an outlet end adapted to be connected to the inlet of a refrigerant evaporator having an outlet connected to the compressor characterized by:

means for forming a first flow path for restricting flow between the inlet and outlet ends of the housing;

an orifice tube having the opposite ends thereof continuously opened and in communication with the inlet and outlet ends of the housing;

means for slideably supporting said orifice tube for movement relative to the housing;

a valve member carried by said orifice tube for opening and closing said first flow path and including means responsive to the pressure differential between the inlet and outlet ends of the housing to position said valve member in its opened or closed position;

a valve body supported in the housing having an upstream part always in communication with the inlet end of the housing, a downstream part always in communication with the outlet end of the housing and an intermediate part defining said first flow path for producing a controlled restriction of flow between the inlet end and the outlet end of the housing;

said first flow path being formed in said intermediate part generally parallel to the longitudinal axis of said intermediate part;

said means for slideably supporting said orifice tube comprised solely by said intermediate part and said first flow path being in parallel with flow through said orifice tube.

9. A variable orifice restrictor valve for controlling refrigerant flow in an automobile air conditioning system wherein the valve has an outer housing with an inlet end adapted to be connected to the outlet of a refrigerant condenser having refrigerant supplied thereby by a compressor driven by the automobile engine and the outer housing further including an outlet end adapted to be connected to the inlet of a refrigerant evaporator having an outlet connected to the compressor characterized by:

means for forming a first flow path for restricting flow between the inlet and outlet ends of the housing;

an orifice tube having the opposite ends thereof continuously opened and in communication with the inlet and outlet ends of the housing;

means for slideably supporting said orifice tube for movement relative to the housing; and a valve member carried by said orifice tube for opening and closing said first flow path and including means responsive to the pressure differential between the inlet and outlet ends of the housing to position said valve member in its opened or closed position;

a stop disk; said valve member formed as a valve disk;

said valve disk and said stop disk respectively connected to the downstream end and upstream ends of said orifice tube and operatively arranged with respect to said valve seat so as to cause refrigerant to simultaneously flow through said first flow path and said orifice tube to flood the evaporator with liquid refrigerant from a compressor with unlimited capacity and when the pressure differential across said orifice tube is raised under engine idle conditions;

said valve disk positioned during operation at lower differential pressures across said orifice tube to close said first flow path for limiting refrigerant flow through only the orifice tube during low load, high speed vehicle operation.

10. A variable orifice restrictor valve for controlling refrigerant flow in an automobile air conditioning system wherein the valve has an outer housing with an inlet end adapted to be connected to the outlet of a refrigerant condenser having refrigerant supplied thereto by a compressor driven by the automobile engine and the outer housing further including an outlet end adapted to be connected to the inlet of a refrigerant evaporator having an outlet connected to the compressor characterized by:

means for forming a first flow path for restricting flow between the inlet and outlet ends of the housing;

an orifice tube having the opposite ends thereof continuously opened and in communication with the inlet and outlet ends of the housing;

means for slideably supporting said orifice tube for movement relative to the housing; and a valve member carried by said orifice tube for opening and closing said first flow path and including means responsive to the pressure differential between the inlet and outlet ends of the housing to position said valve member in its opened or closed position;

a stop disk; said valve member formed as a valve disk;

said valve disk and said stop disk respectively connected to the upstream and downstream ends of said orifice tube and operatively arranged with respect to said valve seat and said first flow path so as to prevent flow through said first flow path at a predetermined high pressure differential across said orifice tube produced in a refrigerant system by a compressor with a limited capacity; and wherein said orifice tube is sized for supplying less liquid refrigerant to the evaporator so as to cause it to run at a lower suction pressure and a corresponding lower core temperature for improving evaporator performance under engine idle conditions;

said valve disk operative under lower differential pressures to open said first flow path to define a combined greater flow area for refrigerant flow for cooling the evaporator under low-load, high-speed, vehicle operation.

* * * * *